US006152361A

United States Patent [19]

Abercrombie et al.

[11] Patent Number: 6,152,361

[45] Date of Patent: Nov. 28, 2000

[54] Z-FOLD BUSINESS MAILER

[75] Inventors: James H. Abercrombie, Little Elm; Thomas A. Goodwin, Dallas, both of Tex.

[73] Assignee: Goodwin Graphics, Inc., Carrollton, Tex.

[21] Appl. No.: 09/259,431

[22] Filed: Mar. 1, 1999

[51] Int. Cl.[7] ..... B65D 27/06

[52] U.S. Cl. ..... 229/305; 229/92.1

[58] Field of Search ..... 229/305, 304, 229/92.1, 92.3

[56] References Cited

U.S. PATENT DOCUMENTS

| | | |
|---|---|---|
| 1,091,172 | 3/1914 | Thayer . |
| 2,317,335 | 4/1943 | Whitman . |
| 2,396,221 | 3/1946 | Yancy . |
| 2,402,821 | 6/1946 | Kosteling . |
| 2,910,222 | 10/1959 | Bermingham, Jr. et al. . |
| 3,113,716 | 12/1963 | Howard . |
| 3,126,148 | 3/1964 | Hanson . |
| 3,143,279 | 8/1964 | Black . |
| 3,152,800 | 10/1964 | Hanson . |
| 3,184,150 | 5/1965 | Hubbard . |
| 3,228,586 | 1/1966 | Hayes, Jr. . |
| 3,255,952 | 6/1966 | Black . |
| 3,270,948 | 9/1966 | Donovan . |
| 3,557,519 | 1/1971 | Lyon, Jr. . |
| 3,652,007 | 3/1972 | MacDougall . |
| 3,791,572 | 2/1974 | Gendron . |
| 3,802,618 | 4/1974 | Wiessner . |
| 3,837,565 | 9/1974 | Johnsen . |
| 3,946,938 | 3/1976 | Kranz . |
| 3,981,435 | 9/1976 | Johnsen . |
| 3,995,808 | 12/1976 | Kehoe . |
| 4,044,942 | 8/1977 | Sherwood . |
| 4,055,294 | 10/1977 | Traise . |
| 4,081,127 | 3/1978 | Steidinger . |
| 4,375,868 | 3/1983 | Slotar et al. . |
| 4,487,360 | 12/1984 | Fisher et al. . |
| 4,575,121 | 3/1986 | Conti . |
| 4,668,211 | 5/1987 | Lubotta et al. . |
| 4,669,652 | 6/1987 | Seguin . |
| 4,706,878 | 11/1987 | Lubotta et al. . |
| 4,715,531 | 12/1987 | Stewart et al. . |
| 4,754,915 | 7/1988 | Steidinger . |
| 4,756,468 | 7/1988 | Jenkins . |
| 4,775,095 | 10/1988 | Emmott . |
| 4,778,101 | 10/1988 | Paquin . |
| 4,830,269 | 5/1989 | Jenkins . |
| 4,889,278 | 12/1989 | Steidinger . |
| 4,896,823 | 1/1990 | Taylor . |
| 4,899,926 | 2/1990 | Spaulding . |
| 4,915,287 | 4/1990 | Volk et al. . |
| 4,918,128 | 4/1990 | Saki . |
| 4,928,875 | 5/1990 | Hutchinson . |
| 4,951,864 | 8/1990 | Dicker . |
| 4,960,237 | 10/1990 | Bendel . |
| 5,046,661 | 9/1991 | Kimura . |
| 5,167,739 | 12/1992 | Hutchinson et al. . |
| 5,174,493 | 12/1992 | File . |
| 5,201,464 | 4/1993 | File . |
| 5,204,464 | 4/1993 | Hagan et al. . |
| 5,253,798 | 10/1993 | Lomardo . |
| 5,263,637 | 11/1993 | Simson . |
| 5,288,014 | 2/1994 | Meyers et al. . |
| 5,289,972 | 3/1994 | Sauerwine et al. ..... 229/305 X |
| 5,290,225 | 3/1994 | Younger . |
| 5,294,041 | 3/1994 | Whiteside . |
| 5,314,110 | 5/1994 | Lombardo . |
| 5,346,123 | 9/1994 | Lombardo . |

(List continued on next page.)

FOREIGN PATENT DOCUMENTS

| | | |
|---|---|---|
| 0 128 643 | 12/1984 | European Pat. Off. . |
| 638772 | 6/1950 | United Kingdom . |
| 638778 | 6/1950 | United Kingdom . |
| 1 594 798 | 8/1981 | United Kingdom . |

*Primary Examiner*—Jes F. Pascua
*Attorney, Agent, or Firm*—David H. Judson

[57] ABSTRACT

All information required for sending a business form mailer to a recipient, a preconstructable return envelope and a return data receipt are printed on a single side of a Z-foldable form.

19 Claims, 11 Drawing Sheets

U.S. PATENT DOCUMENTS 5,366,145 11/1994 Sauerwine ..... 229/92.3 X
5,370,304 12/1994 Sauerwine et al. .
5,375,764 12/1994 Sauerwine .
5,425,500 6/1995 Sauerwine .
5,513,795 5/1996 Sauerwine ..... 229/305
5,553,774 9/1996 Goodno .
5,752,647 5/1998 Schubert et al. ..... 229/305 X
6,003,760 12/1999 Abercrombie ..... 229/305
6,015,085 1/2000 Cannon et al. ..... 229/305

Z-FOLD BUSINESS MAILER

BACKGROUND OF THE INVENTION

1. Technical Field

This invention relates generally to a single sheet business form mailer, and more particularly to a two-way Z-fold business form mailer having a preconstructed return envelope.

2. History of Related Art

Business form mailers adapted to be used to both transmit customer or recipient information, such as invoices, and return information and/or other articles, such as payment receipts and checks, are commonly used in the course of everyday commerce. For example, U.S. Pat. No. 5,201,464, issued Apr. 13, 1993, to Jerry E. File for *Pressure Seal C-fold Two-way Mailer* describes a single sheet business form mailer which, in one arrangement, variable data requires duplex printing on both sides of the form, while in a second embodiment, variable data is printed on only a single side of the form but requires a die-cut window so that the outgoing address information is visible from the exterior of the mailer. Duplex printing of variable data on a business form requires twice the time to print on both sides of the form, thereby increasing processing time and expense to prepare the forms for mailing. Additionally, the paper utilized in duplex printing will often curl, causing feeding problems through the printer. Furthermore, die-cut windows add significantly to the cost of the form and adversely affect the stackability and storage of the forms due to puckering of the cut forms at the corners of the die-cut window.

U.S. Pat. No. 5,513,795, issued May 7, 1996 to Dean N. Saurwine, discloses a Z-fold mailer with a reusable reply envelope. This form also requires duplex printing, i.e., the printing of variable information on both sides of the form. Also, after receiving the mailer, the initial addressee must carefully construct a return envelope in such a way as to cover any remaining original address indicia on the reply envelope.

More recently, co-pending U.S. patent application Ser. No. 09/100,473, filed June 1998, for a *Two-way Z-fold Business Form Mailer* by James Harold Abercrombie, a co-inventor of the present invention, discloses a two-way mailer that addresses some of the problems inherent in the above-described prior art. While the business form mailer in the co-pending application offers many advantages, the form requires that the addressee remove tear tabs along the side of the form to open the form and then re-moisten moisture-activated adhesive strips provided along three edges to form a return envelope.

The present invention is directed to overcoming the problems set forth above. It is desirable to have a business form mailer in which all variable information to be entered on the form can be printed on a single surface by one pass through a simplex or laser single-side printer. It is also desirable to have such a form that does not require die-cut windows and is stackable for compact storage for relatively long periods of time. It is also desirable to have such a mailer in which the return envelope is preconstructed so that the initial addressee merely has to seal one side to close the envelope before returning it with payment or other return information.

SUMMARY OF THE INVENTION

In accordance with one aspect of the present invention, a Z-fold business form has front and rear faces, top and bottom edges, and first and second lines of weakness disposed in spaced-apart parallel relationship with the top and bottom edges and with each other. The Z-fold business form has a first panel having a front face disposed on the front face of the form and a rear face disposed on the rear face of the form. The first panel is defined by the top edge of the form, the first line of weakness, and two parallel spaced-apart side edges. The first panel has a plurality of discrete, coactive adhesive areas, for example areas coated with a heat or pressure-sensitive adhesive that will stick to another area coated with the same or a similar coactive adhesive but will not readily adhere to areas not coated with the coactive adhesive, are disposed on the front face of the panel in a defined pattern adjacent the top edge and the two side edges of the panel. The Z-fold business form has a second panel having a front face disposed on the front face of the form and a rear face disposed on the rear face of the form. The second panel is defined by the first line of weakness, the second line of weakness, and two parallel spaced-apart side edges. The second panel has a plurality of discrete coactive adhesive areas disposed on the front face of the second panel in a predetermined pattern that coincides with the defined pattern of the coactive adhesive areas of the first panel when the form is folded along the first line of weakness and the front face of the first panel is brought into contact with the front face of the second panel. The second panel also includes a plurality of discrete coactive adhesive areas disposed on the rear face in a predetermined pattern adjacent the first line of weakness and along the two side edges. The Z-fold business form also includes a third panel having a front face disposed on the front face of the form and a rear face disposed on the rear face of the form. The third panel is defined by the second line of weakness, the bottom edge of the form, and two parallel spaced-apart side edges. The third panel has a plurality of discrete coactive adhesive areas disposed on the rear face of the panel in a predetermined pattern that coincides with the predetermined pattern of coactive adhesive areas on the rear face of the second panel when the form is folded along the second line of weakness and the rear face of the second panel is brought into contact with the rear face of the third panel.

The Z-fold business form embodying the present invention also has a third line of weakness extending between the first line of weakness and the bottom edge of the form in parallel relationship with the side edges. The third line of weakness divides the second and third panels into separate return envelope and data portions. A return envelope is constructed in response to folding the form along the second line of weakness, thereby forming a first closed side of the return envelope, then bringing the rear faces of the second and third panels into mutual contact and activating the coactive adhesive disposed on the respective rear faces of the second and third panels, thereby forming second and third closed sides of the return envelope.

The Z-fold business form also includes a selectively-activated adhesive disposed on the rear face of a selected one of the second and third panels at a position along a fourth side of the return envelope portion. After separation of the first panel from the second panel and separation of the data portion from the return envelope portion of the second and third panels, the fourth side of the return envelope is sealed in response to activating the selectively-activated adhesive.

Other features of the Z-fold business form embodying the present invention include the form having a fourth line of weakness formed in the second and third panels in parallel spaced relationship with the third line of weakness, thereby defining a tab portion of the return envelope between the third and fourth lines of weakness. The selectively-activated adhesive is disposed on the thus-defined tab portion.

Other features of the Z-fold business form embodying the present invention include the first, second, third, and fourth lines of weakness being respectively formed by a plurality of perforations.

Still other features of the Z-fold business form embodying the present invention include the coactive adhesive areas having a coating of a pressure-activated adhesive, or alternatively, a coating of a heat-activated adhesive deposited on the areas. Other features include the coactive adhesive areas on the front face of the second and third panels collectively having a smaller surface area than the collective surface area of the coactive adhesive areas on the rear faces of the second and third panels, and the predefined pattern of the coactive adhesive areas disposed on the front face of the second panel being non-aligned with respect to the predefined pattern of coactive adhesive areas on the rear face of the second panels, thereby permitting the forms to be stacked with respective front faces all facing in the same direction without the coactive adhesive areas of adjacently stacked forms being positioned in mutual contact.

Additional features include the selectively-activated adhesive being a moisture-activated adhesive or, alternatively, a pressure-sensitive adhesive that is exposed by removal of a release liner.

An important additional feature of the Z-fold business form embodying the present invention includes the front face of the form being arranged to receive selectively printed information, whereas the rear face of the form is a preprinted form with non-specific information such as initial opening instructions and privacy markings.

Still additional features of the Z-fold business form embodying the present invention include the first, second and third panels each having generally equal height and width, or, alternatively, the form being folded into an eccentric Z-pattern so that the third panel has a height less than that of the first and second panels.

Yet another important feature of the Z-fold business form embodying the present invention includes the front face of the form being arranged to be selectively printed with address and account information specific to a predesignated recipient and use application, and the rear face of the form being preprinted with nonspecific markings and instructions applicable to all use applications regardless of sender or recipient.

BRIEF DESCRIPTION OF THE DRAWINGS

A more complete understanding of the structure and operation of the present invention can be had by reference to the following detailed description when taken in conjunction with the accompanying drawings, wherein.

DETAILED DESCRIPTION OF THE PRESENTLY PREFERRED EMBODIMENTS

Figure 1:
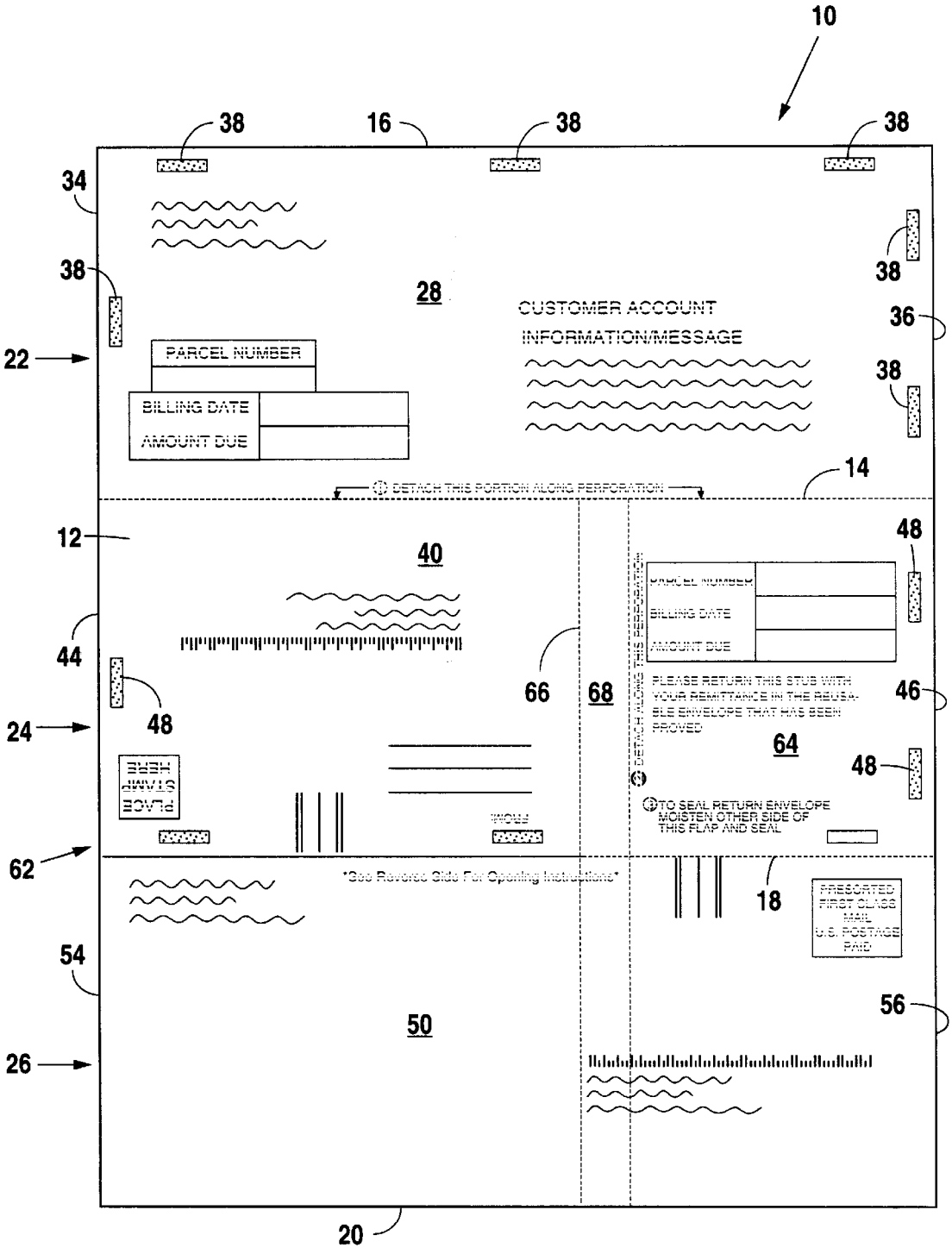
FIG. 1 is a plan view of the front face of the Z-fold business form mailer embodying the present invention.
Figure 2:
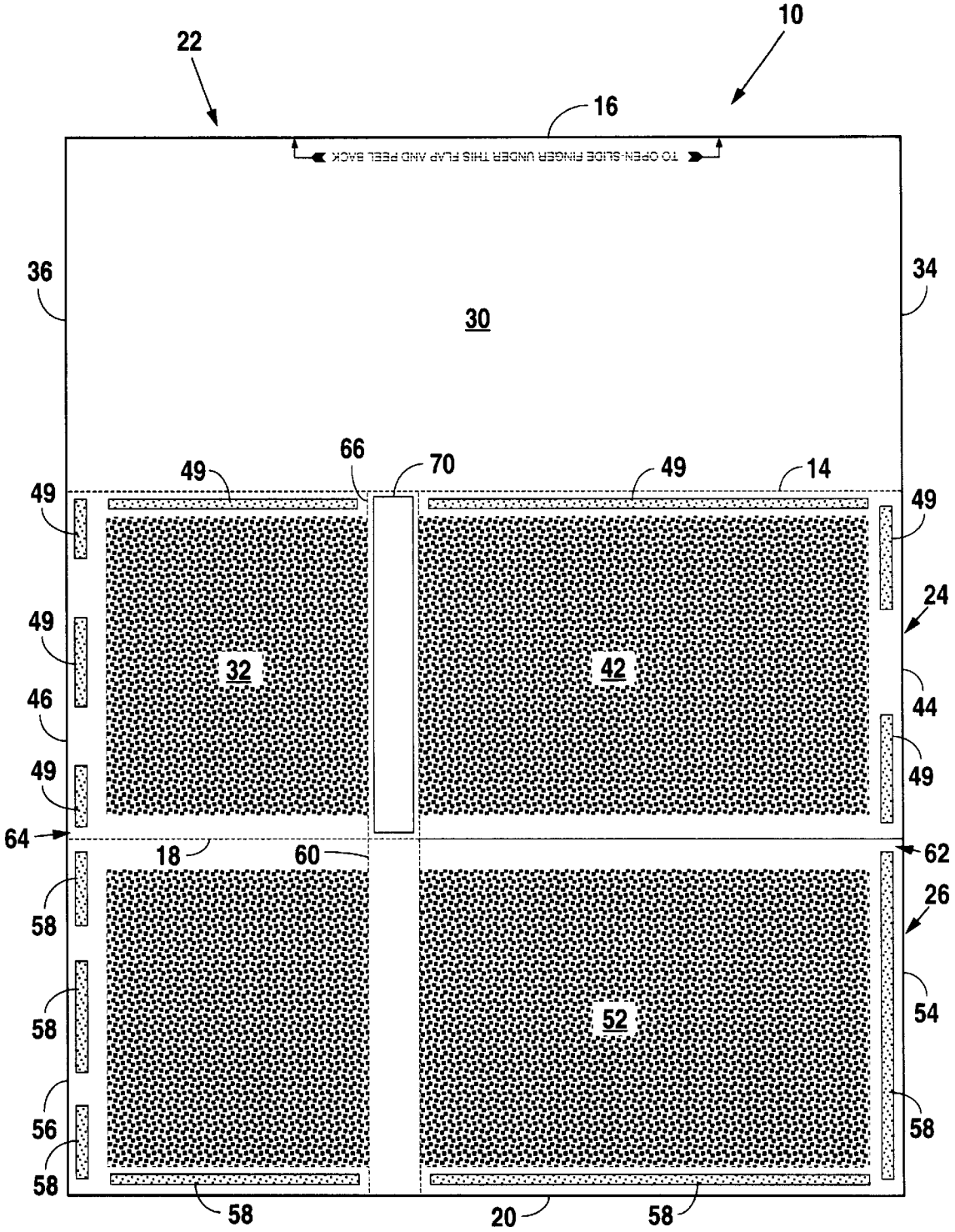
FIG. 2 is a plan view of the rear face of the Z-fold business form mailer embodying the present invention.
Figure 3:
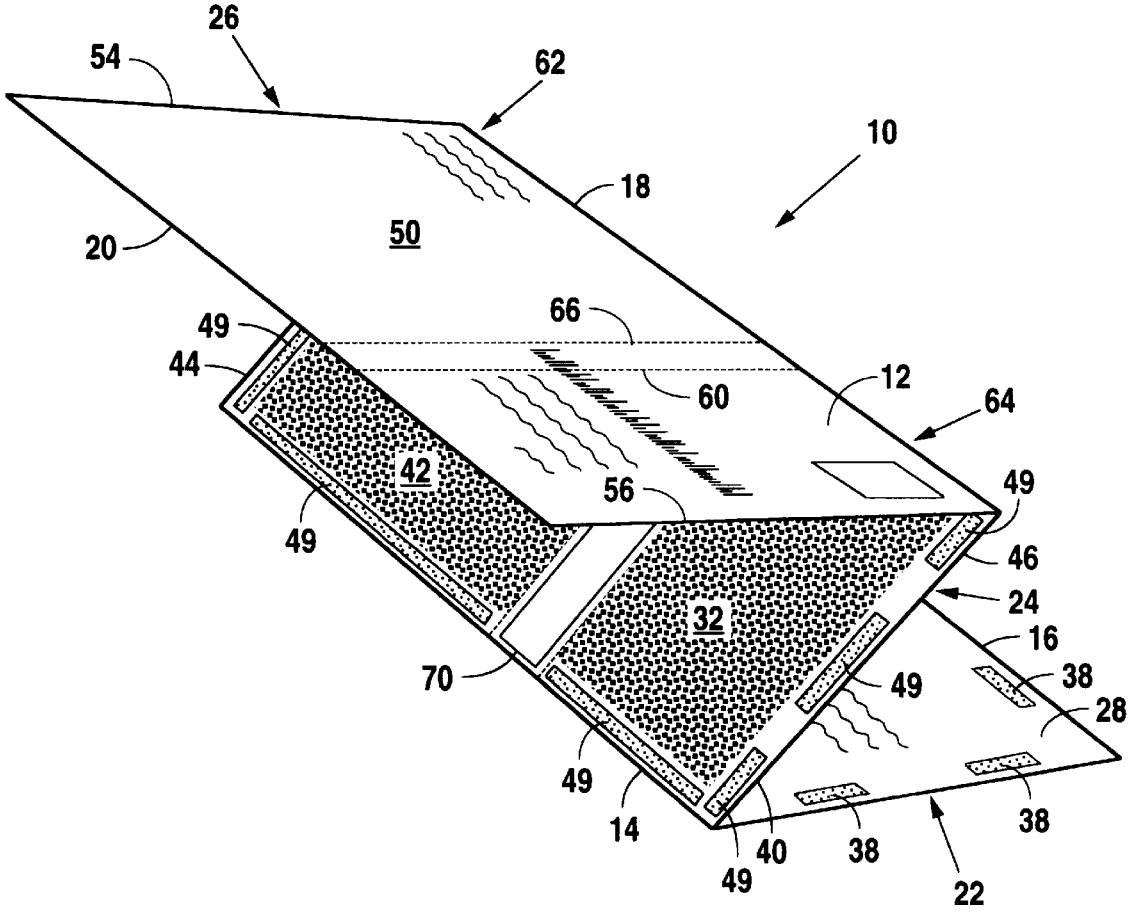
FIG. 3 is a three-dimensional view of the Z-fold business form mailer embodying the present invention, showing the form in a partially folded position.

A first preferred embodiment of the Z-fold business form mailer embodying the present invention is generally indicated by the reference numeral 10 in FIGS. 1–8. As best shown in FIG. 1, a front face 12 of the form is divided into three panels that are separated by a first line of weakness 14, preferably formed by a line of perforations extending transversely across the form 10 in parallel space relationship with a top edge 16, and a second line of weakness 18 provided by a series of perforations extending partially across the form in parallel spaced relationship with the first line of weakness 14, the top edge 16, and a bottom edge 20. The first and second lines of weakness 14, 18 provide lines along which the form may be folded into a Z-shape, as illustrated in FIG. 3, thereby dividing the form into three panels, 22, 24, 26. The terms "top edge" and "bottom edge" are relative terms, depending on the vertical orientation of the form sheet. In addition, it will be noted that the printed information on one panel may be upside-down with respect to the printed information on an adjacent panel. For consistency throughout the following description of the form 10 embodying the present invention, the top edge 16 is the edge extending transversely across the form 10 adjacent the first panel 22.

The first panel 22 has a front face 28 disposed on the front face 12 of the form 10 and a rear face 30, as shown in FIG. 2, disposed on a rear face 32 of the form 10. The first panel 22 is thus defined by the top edge 16 of the form 10, the first line of weakness 14, and two parallel spaced-apart side edges 34, 36, each respectively extending between the top edge 16 of the form 10 and the first line of weakness 14. A plurality of relatively small, discrete coactive adhesive areas 38 are disposed on the front face 28 of the first panel 22 in a predetermined pattern adjacent the top edge 16 and the side edges 34, 36. The term "coactive adhesive," as used herein, means an adhesive material that will join with itself, but has little or no tendency to bond with a dissimilar material such as paper. An example of such a coactive adhesive material is latex-based pressure seal adhesive. An area coated with a coactive adhesive will stick to another area coated with the same or a similar coactive adhesive when subjected to pressure or heat, but will not readily adhere to areas not coated with the coactive adhesive material. Joining the contacting coactive adhesive areas is easily carried out by pressing, or flattening the form 10 after printing and folding. Alternatively, the coactive adhesive areas 38 may contain a heat-activated adhesive that provides a mutual bond between adjacently disposed adhesive areas by the application of a supplemental heat source after printing and folding.

The second panel 24 has a front face 40 disposed on the front face 12 of the Z-fold form 10 and a rear face 42 (shown in FIG. 2) disposed on the rear face 32 of the form 10. The second panel 24 is defined by the first line of weakness 14, the second line of weakness 18 resulting from the perforations extending transversely across a portion of the form 10, and two parallel spaced-apart side edges 44, 46, each respectively extending between the first and second lines of weakness 14, 18. The second panel 24 has a plurality of relatively small, discrete coactive adhesive areas 48 disposed on the front face 40 of the second panel 24 in a predetermined pattern that coincides with the predetermined pattern of the coactive adhesive areas 38 disposed on the front face 28 of the first panel 22. Thus, when the form 10 is folded along the first line of weakness 18, and the front face 28 of the first panel 22 brought into facing abutment with the front face 40 of the second panel 24, the coactive adhesive areas 38, 48 are aligned with each other, and maintain the respective first and second panels 22, 24 in a fixed, but easily separable, abutting relationship with each other. As shown in FIG. 2, the rear face 42 of the second panel 24 has a plurality of relatively large, or elongated, coactive adhesive areas 49 disposed adjacent the first line of weakness 14 and the side edges 44, 46 of the second panel 24.

The third panel 26 of the Z-fold business form mailer 10 embodying the present invention has a front face 50 disposed on the front face 12 of the form 10, and a rear face 52 disposed on the rear face 32 of the form 10. The third panel 26 is defined by the second line of weakness 18, the bottom edge 20 of the form 10, and by two parallel spaced-apart side edges 54, 56, each respectively extending between the second line of weakness 18 and the bottom edge 20. As shown in FIG. 2, the rear face 52 of the third panel 26 has a plurality of relatively large, elongated coactive adhesive areas 58 disposed on the rear face 52 in a predetermined pattern that coincides with the predetermined pattern of coactive adhesive areas 49 on the rear face 42 of the second panel 24. Thus, when the form 10 is folded along the second line of weakness 18 in the manner shown in FIG. 3, the rear face 42 of the second panel 24 is brought into contact with the rear face 52 of the third panel 26. Upon contact, the coactive adhesive areas 49, 58 respectively disposed on the rear faces 42, 52 are positioned in mutual abutting relationship, whereby upon activation of the coactive adhesive by pressure or heat, the r ear face 42 of second panel 24 is joined with the rear face 52 of third panel 26.

A third line of weakness 60 is formed in the second and third panels 24, 26 and extends between the first line of weakness 14 and the bottom edge 20 of the form 10 in parallel relationship with the side edges 44, 46, 54, 56. The third line of weakness 60, preferably a line of perforations, serves to separate the second and third panels 24, 26 into a return envelope portion, generally identified by the reference numeral 62, and a separable return receipt or data portion, generally defined by the reference numeral 64. As can be seen from the above discussion, the return envelope portion 62 is already constructed, or preassembled, upon receipt of the form by the initial addressee as a result of folding the form 10 along the second line of weakness 18, thereby forming one closed folded edge of the return envelope portion 62, and then bringing the respective rear faces 42, 52 of the second and third panels 24, 26 into sealing abutment whereby the coactive adhesive areas 49, 58 provide two additional sealed edges of the return envelope portion 62.

The Z-fold business form mailer 10 embodying the present invention desirably also includes a fourth line of weakness 66 which may be readily provided by a series of perforations extending at least partially across the second and third panels 24, 26, in parallel spaced relationship with the third line of weakness 60. The fourth line of weakness 66, at least the portion of the fourth line of weakness 66 extending through the third panel 26 in cooperation with the portion of the third line of weakness 60 extending through the second panel 24, provides for easy separation of the return envelope portion 62 and the return receipt-data portion 64, as will be described below in additional detail, as well as provide a tab portion 68, or flap, that can be folded over after separation to seal the fourth edge of the return envelope portion 62. Desirably, a rear face 70 of the tab 68 (as shown in FIG. 2), is coated with a selectively-activated adhesive, such as a remoistenable adhesive, so that the initial recipient of the mailer can, after inserting payment or other material in the envelope portion 62, seal the envelope 62 prior to returning it as a return envelope. Alternatively, instead of an adhesive activated by moisture, the rear face 70 of the tab portion 68 may be coated with a pressure-sensitive adhesive and a release film, or liner, provided thereon which can be removed when desired to expose the pressure-sensitive surface.

Importantly, as illustrated in FIGS. 1 and 2, all variable data, e.g., customer account information or data, billing information, messages, return envelope address, return receipt stub, and initial recipient address are all printed on the front face 12 of the Z-fold form 10 embodying the present invention. The rear face 32 of the form 10 contains only non-variable information, such as initial opening instructions desirably positioned along the top edge 16, and security or privacy markings, if so desired, on the rear faces 32, 42 of the second and third panels 24, 26, particularly in the return envelope portion 62 of those panels. Thus, the Z-fold business form mailer 10 embodying the present invention can be stocked as a standard item, suitable for use by a variety of businesses or others, which only have single-side printing capability. This not only reduces inventory cost, but also the forms can be prepared by anyone having a conventional laser or other single-side printer. It should be noted that, in order to prevent contact between coactive adhesive areas disposed on the front face 12 and rear face 32 of the forms 10 during storage, that only the second panel 24 contains a coactive adhesive area on both front and rear faces of that portion of the form. Moreover, the relatively small coactive adhesive areas 38 on the front face 40 of the second panel 24 is arranged so that it is non-aligned with the relatively larger coactive adhesive areas 49 on the rear face 42 of the second panel 24. Thus, when the forms 10 are serially stacked as single sheets, with the front face 12 of each sheet facing the rear face of a superimposed sheet, none of the coactive adhesive areas are aligned, thereby preventing sticking or nominal adherence between sheets.

Figure 4:
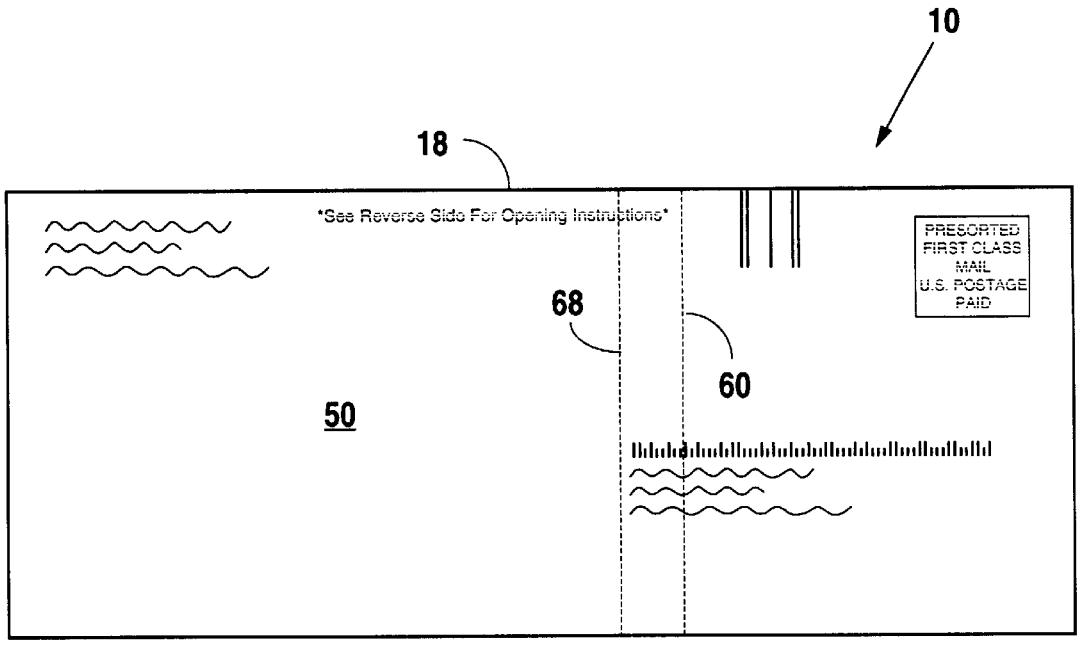
FIG. 4 is a front view of the folded Z-fold business form mailer embodying the present invention.
Figure 5:
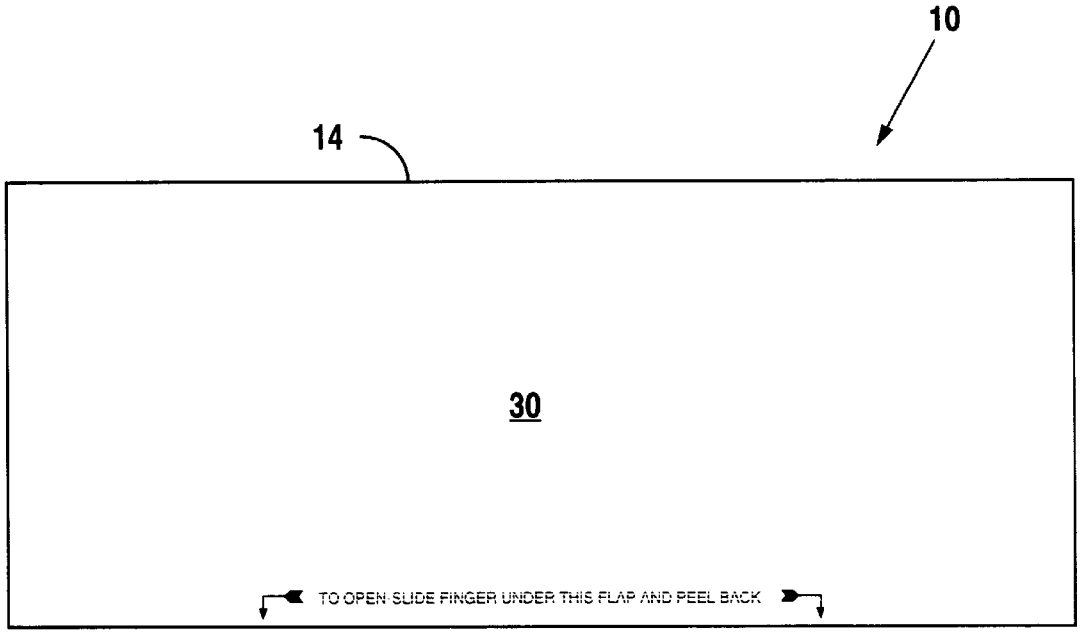
FIG. 5 is a rear view of the folded Z-fold business form mailer embodying the present invention.
Figure 6:
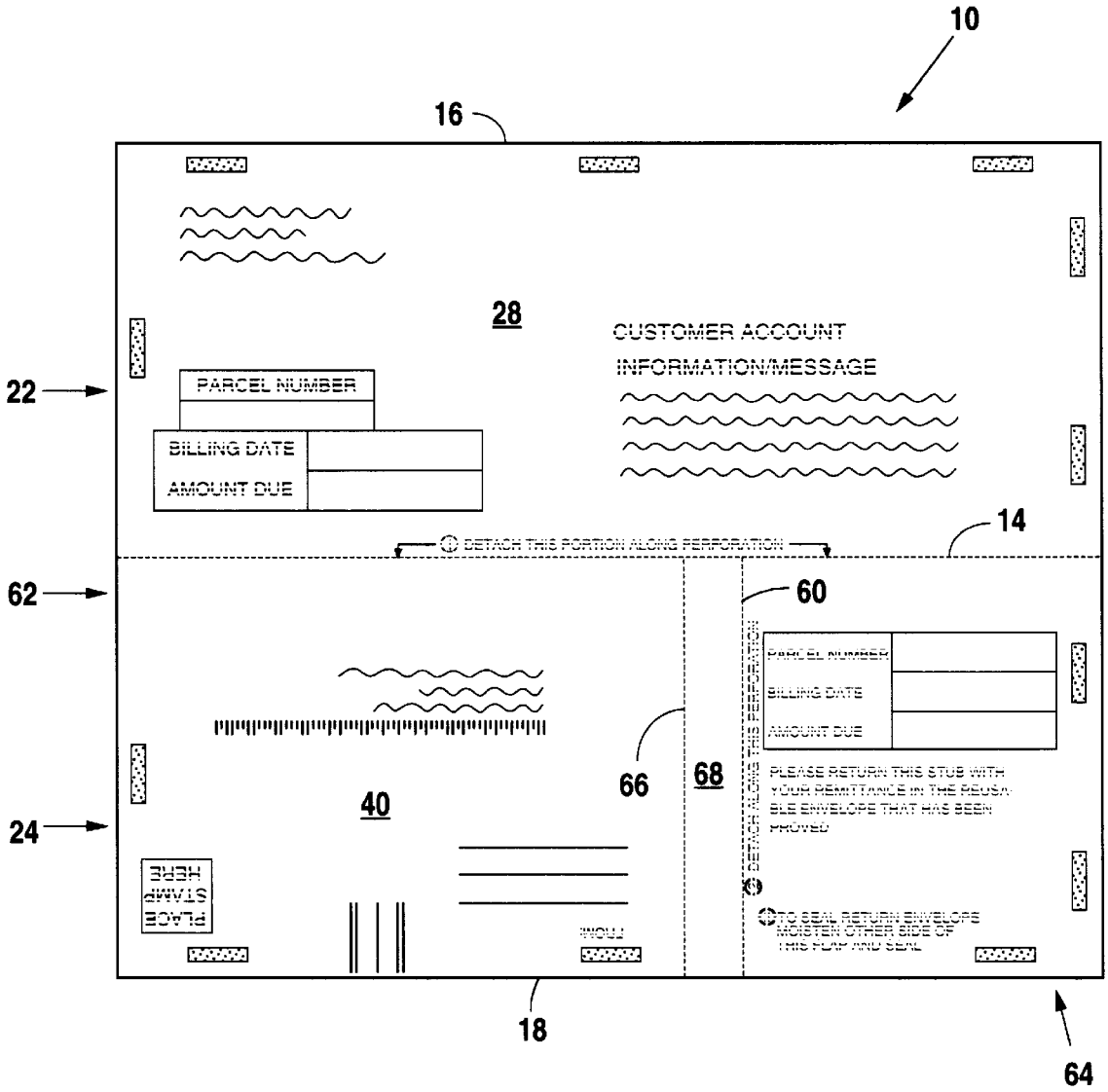
FIG. 6 is a plan view of the Z-fold business form mailer embodying the present invention after opening by a recipient.

Turning now to FIG. 3, after printing of all variable information on the front face of the Z-fold business form mailer 10 embodying the present invention, the form is folded along the first and second lines of weakness, 14, 18, so that the front face 28 of the first panel 22 faces the front face 40 of the second panel 24, and the rear face 42 of the second panel 24 faces the rear face 52 of the third panel 26. After folding, the form is pressed to seal the contacting coactive adhesive areas, aided by the application of heat if required, and thereby form a flat mailer wherein the front face 50 of the third panel 26 contains the initial addressee name and address, indicia for postage, mail sorting bar code, and return address block, as shown in FIG. 4. Since desirably, no variable information is printed on the rear face 32 of the form 10, the rear face 30 of the first panel 22, providing the back side of the folded mailer as shown in FIG. 5, contains only instructions for initially opening the received mailer. Because the coactive adhesive areas 38, 48 on the abutting front faces 28, 40 of the first and second panels 22, 24, are relatively small, the form can be readily opened by the recipient in response to simply inserting a finger between the first and second panels 22, 24 and urging the front faces 28, 40 away from each other thereby opening the mailer to its opened position, as shown in FIG. 6.

Figure 7:
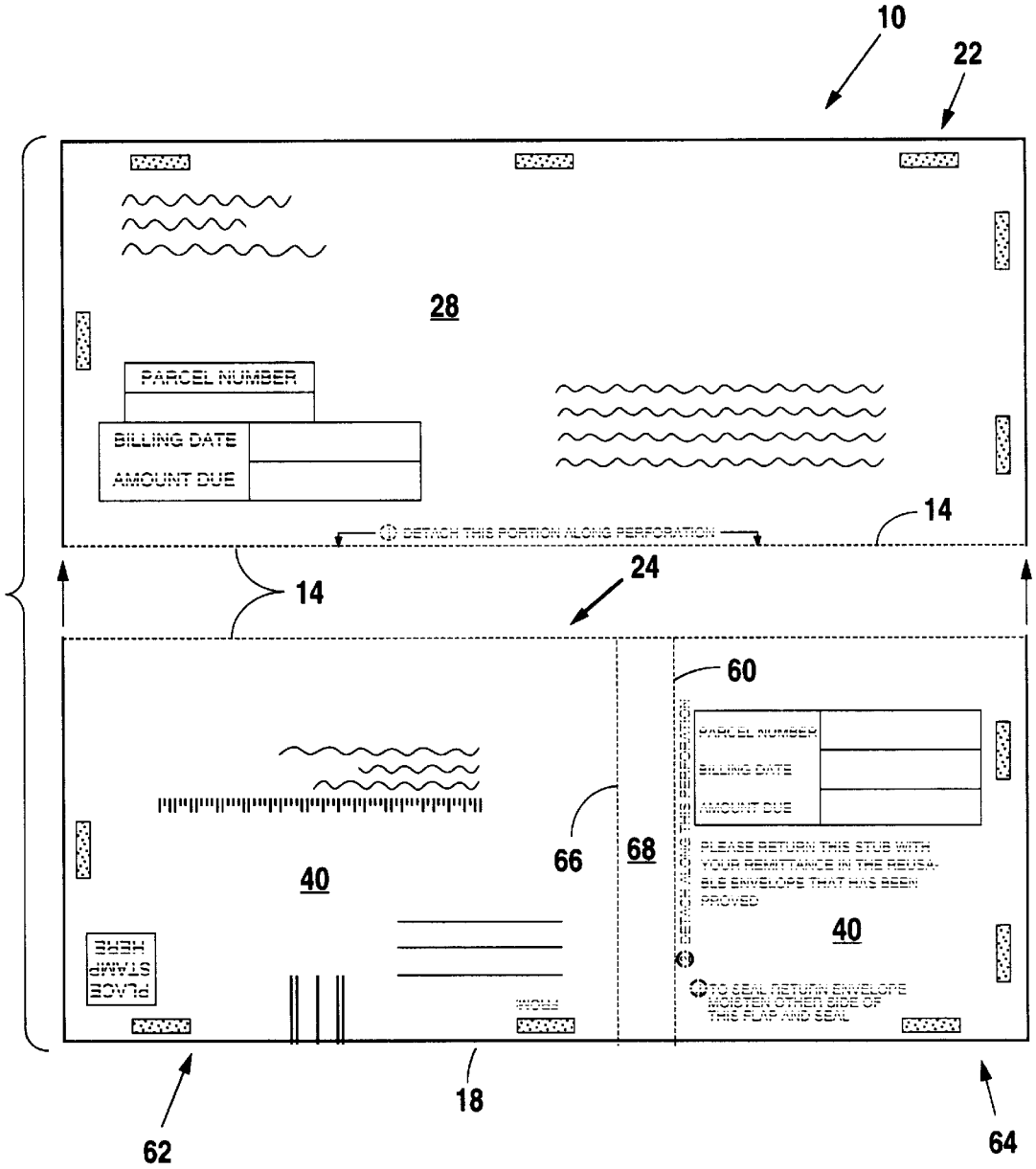
FIG. 7 is a plan view of the Z-fold business form mailer embodying the present invention after opening by a recipient and separation of the recipient's information or billing statement from the form.
Figure 8:
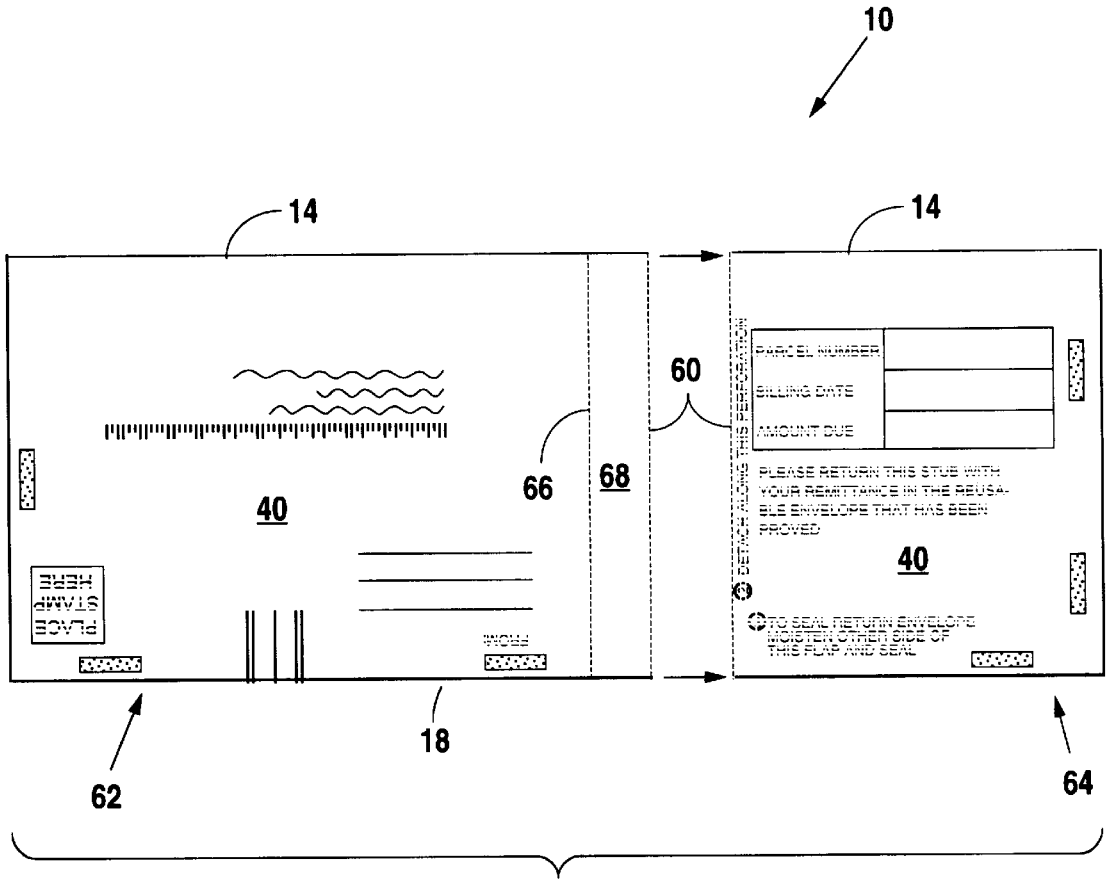
FIG. 8 is a plan view of the lower portion of the opened Z-form business form mailer, showing separation of the return receipt stub from the return envelope portion of the mailer.
Figure 9:
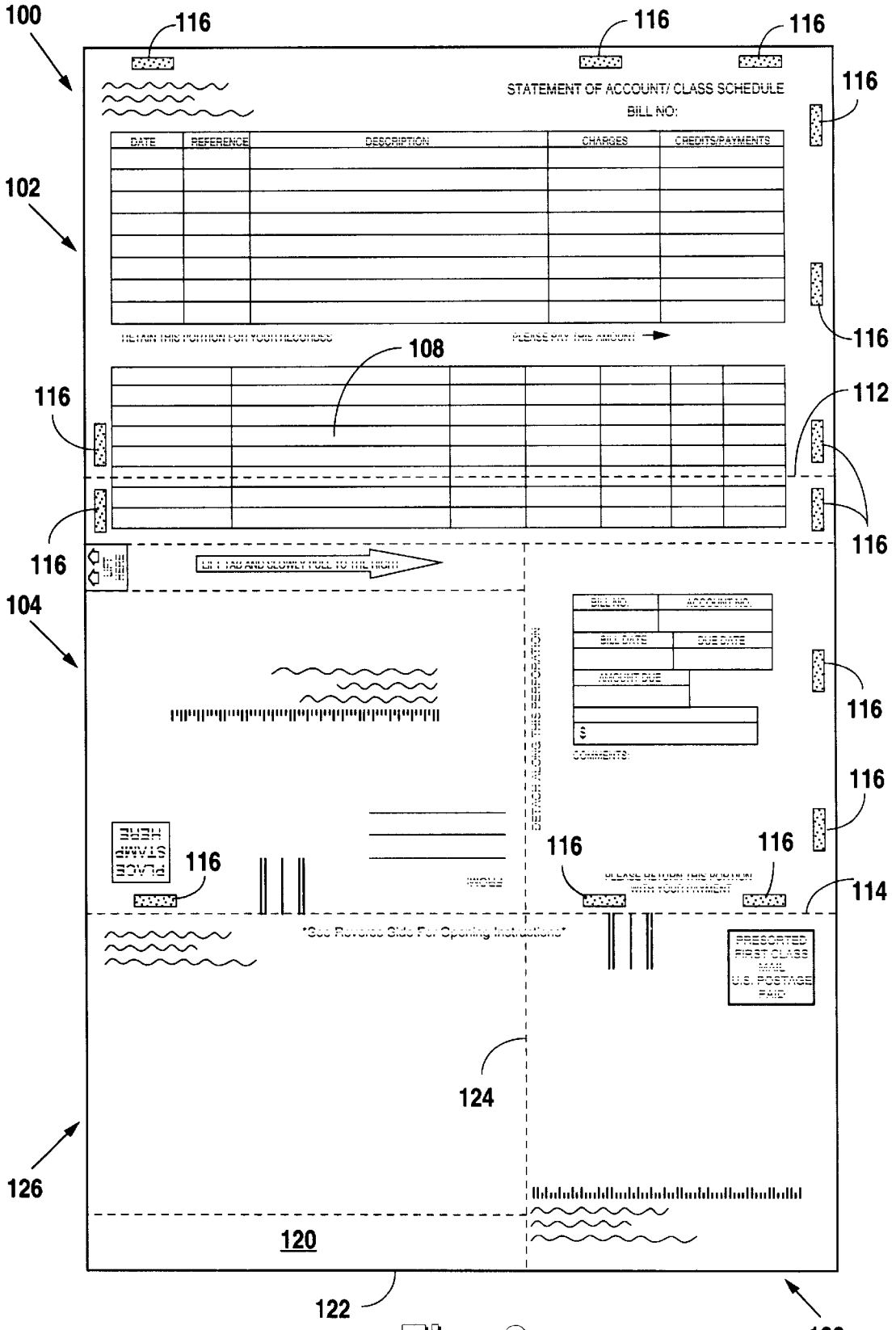
FIG. 9 is a plan view of the front face of an eccentric Z-fold business form mailer embodying the present invention.
Figure 10:
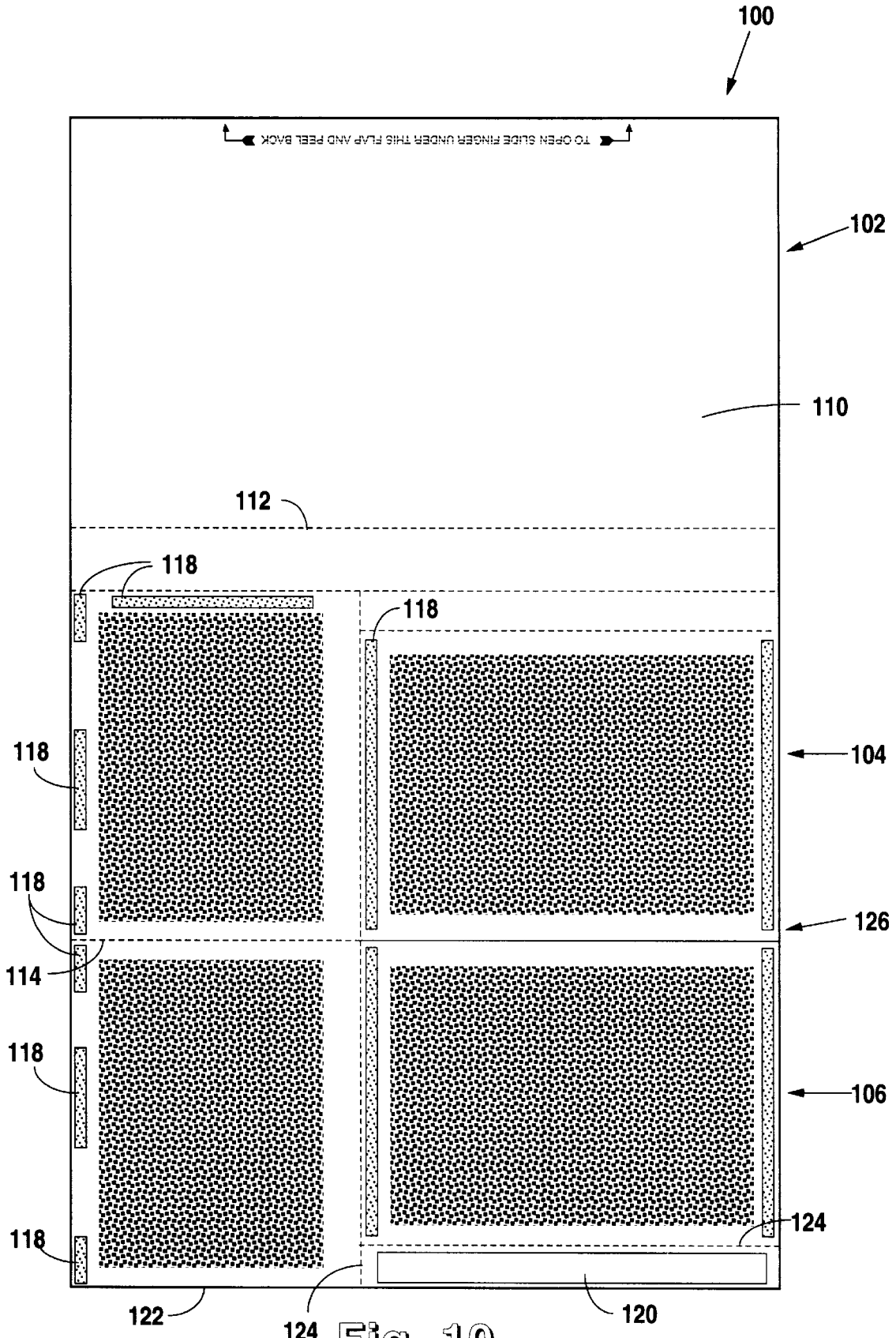
FIG. 10 is a rear view of the eccentric Z-fold business form mailer embodying the present invention.

After receipt and initial opening of the Z-fold business form mailer 10 embodying the present invention, the first panel 22 containing customer/recipient information is readily separated from the return envelope portion 62 and return receipt/data portion 64 by tearing across the perforated first line of weakness 14, as shown in FIG. 7. After separation of the first panel 22 from the return envelope portion 62 and return receipt data portion 64, the return receipt portion 64 can be separated from the return envelope by tearing along the perforations forming the third line of weakness 60, as shown in FIG. 8. The return receipt position 64 may then be inserted into the return envelope portion 62, along with a check for any payment due, the flap portion 68 folded along the fourth line of weakness 66, and sealed, thus sealing the enclosures within the return envelope. As illustrated in FIGS. 1, 7, and 8, the front face 40 of the second panel 24 advantageously is selectively printed with a return address, postal sorting codes, and stamp placement information.

In the first embodiment of the Z-fold business form mailer 10, illustrated in FIGS. 1–8, the first, second and third panels, 22, 24, 26, all have generally the same height, width, and, accordingly, surface area. Advantageously, standard paper sizes are suitable for use in carrying out the present invention, and provide a return envelope that is larger than the minimum size requirements of the U.S. Postal Service. There are a myriad of standard paper sizes, which include 8½×11 inches, 8½×13 inches, 8½×14 inches, 11×17 inches and A4 (8.27×11.69 inches). In summary, there are many standard paper sizes, and each of these could incorporated into the teachings of the present invention.

A second preferred embodiment of the Z-fold business form mailer is generally indicated in FIGS. 9–12 by the reference numeral 100. The alternate embodiment of the Z-form business mailer 100 is an eccentrically Z-folded form in which a first panel 102 and a second panel 104 generally have the same height, width, and surface area, and a third panel 106 has a width equal to the first and second panels 102, 104, but has a height less than that of the first and second panels 102,104. Typically, the eccentric Z-fold form 100 is printed on 8½×13 or 8½×14 paper to assure that the return envelope is large enough to satisfy postal service requirements. As in the earlier embodiments, all variable address, customer, and other information and records are printed on a single side, i.e., a front face 108 of the form 100. If desired, privacy markings for the return envelope and initial opening instructions may be preprinted on a rear face 110 of the form 100.

Figure 11:
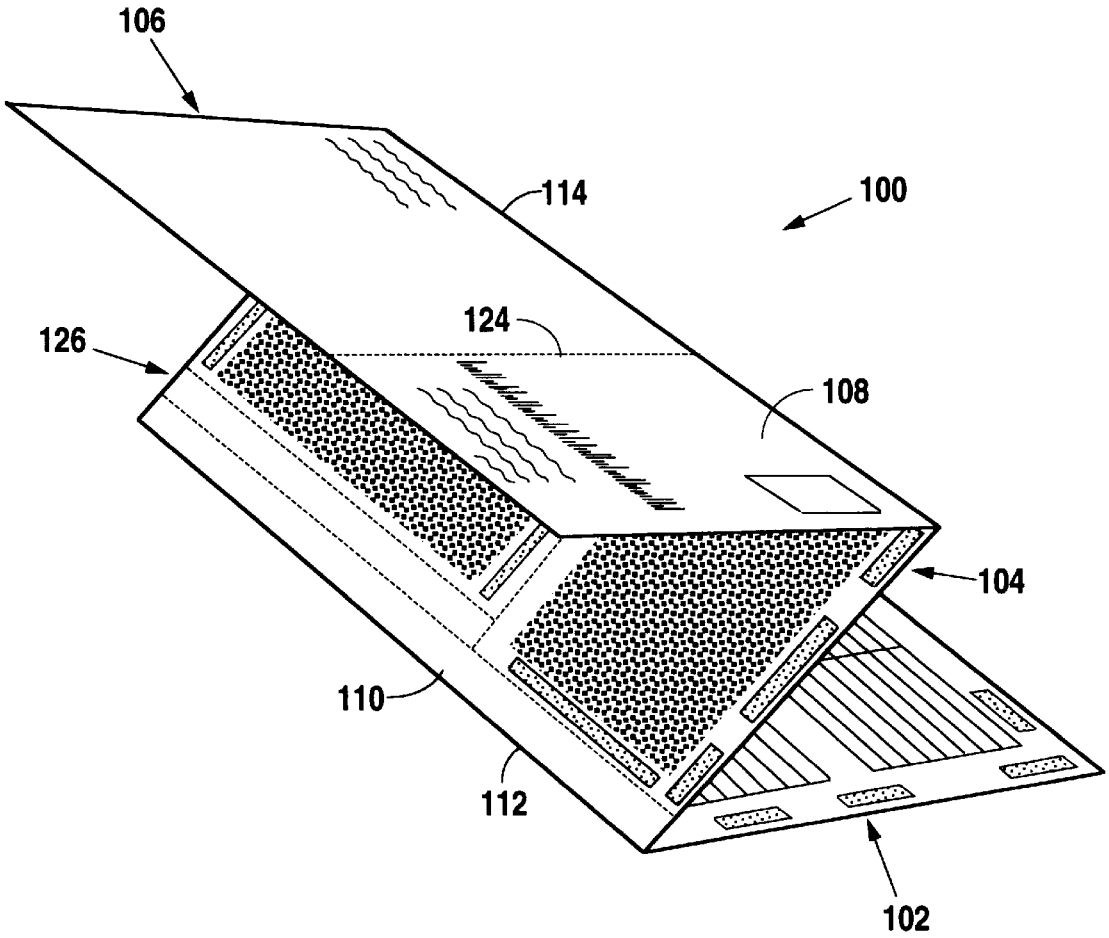
FIG. 11 is a three-dimensional view of the eccentric Z-fold business form mailer embodying the present invention, showing the form in a partially folded position.
Figure 12:
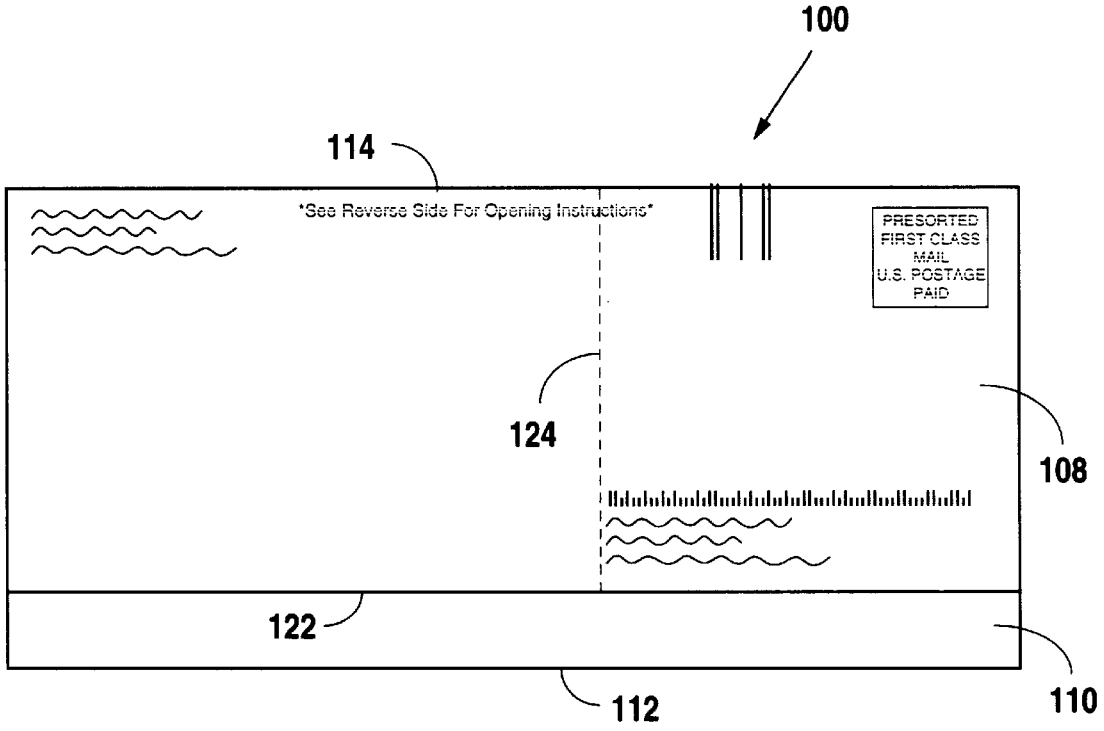
FIG. 12 is a plan view of the front of the eccentric Z-form business mailer embodying the present invention.

The eccentric Z-fold business form mailer 100 is folded along a first line of weakness 112, in which the front faces of the first and second panels 102, 104 are brought into mutual contacting relationship, and then folded along a second line of weakness 114 as shown in FIG. 11. After folding and flattening, the eccentric Z-fold business form mailer 100 is illustrated in FIG. 12. As in the earlier described conventional Z-fold mailer 10, the eccentrically folded form has similar relatively small discrete areas 116 on the front faces of the first and second panels 102,104, that are coated with a coactive adhesive. The rear face 110 of the eccentric Z-fold business form mailer has a plurality of coactive adhesive areas 118 that seal two sides of the return envelope, while a third side is closed as a result of folding the form along the second line of weakness 114. A return receipt stub 128 is separable from a return envelope portion 126 along a third line of weakness 124. Also, in this arrangement, a flap 120 is provided along a bottom edge 122 which can be folded over to seal a fourth side of a return envelope portion 126 in response to activating an adhesive provided on the rear surface of the flap 120, such as by moistening. Alternatively, the flap portion 120 could be formed adjacent to the first line of weakness 112 or along a third line of weakness 124 at a vertical edge of the envelope portion 126 as described above in the preceding embodiment.

Although the present invention is described in terms of preferred exemplary embodiments, with specific variable data arrangements and envelope constructions, those skilled in the art will recognize that changes in those arrangements and constructions may be made without departing from the spirit of the invention. Such changes are intended to fall within the scope of the following claims. Other aspects, features, and advantages of the present invention may be obtained from a study of this disclosure and the drawings, along with the appended claims.

What we claim is:

1. A Z-fold business form having a front face, a rear face, a top edge a bottom edge, and first and second lines of weakness disposed in spaced apart parallel relationship with said top and bottom edges and with each other, said form comprising:

a first panel having a front face disposed on the front face of the form and a rear face disposed on the rear face of the form, said first panel being defined by the top edge of said form, said first line of weakness, and two parallel spaced apart side edges, each respectively extending between said top edge of the form and said first line of weakness, and having a plurality of discrete coactive adhesive areas disposed on the front face of the first panel in a predefined pattern adjacent said top edge and said side edges;

a second panel having a front face disposed on the front face of the form and a rear face disposed on the rear face of said form, said second panel being defined by said first line of weakness, said second line of weakness, and two parallel spaced apart side edges each respectively extending between said first and second lines of weakness, said second panel having a plurality of discrete coactive adhesive areas disposed on the front face of the second panel in a predetermined pattern that coincides with the predetermined pattern of the coactive adhesive areas of said first panel when the form is folded along the first line of weakness and the front face of the first panel is brought into contact with the front face of the second panel, and a plurality of discrete coactive adhesive areas disposed on the rear face of the second panel in a predetermined pattern adjacent said first line of weakness and said side edges of the second panel;

a third panel having a front face disposed on the front face of the form and a rear face disposed on the rear face of said form, said third panel being defined by said second line of weakness, said bottom edge of the form, and two parallel spaced apart side edges, each respectively extending between said second line of weakness and said bottom edge of the form, said third panel having a plurality of discrete coactive adhesive areas disposed on the rear face in a predetermined pattern that coincides with the predetermined pattern of the coactive adhesive areas on the rear face of said second panel when the form is folded along said second line of weakness and the rear face of the second panel is brought into contact with the rear face of the third panel;

a third line of weakness formed only in said second and third panels extending between the first line of weakness to the bottom edge of the form in parallel relationship with said side edges, said third line of weakness defining separate return envelope and data portions, said return envelope being constructed in response to folding said form along said second line of weakness thereby forming a first closed side of said return envelope, bringing said rear faces of the second and third panels into mutual contact and activating said coactive adhesive disposed on the respective rear faces of the second and third panel, thereby forming second and third closed sides of said return envelope; and a selectively activated adhesive disposed on the rear face of a selected one of said second and third panels at a position along a fourth side of said return envelope portion, whereby after separation of said first panel from said second panel and separation of said data portion from said envelope portion, the fourth side of said return envelope is sealed in response to activating said selectively activated adhesive.

2. The Z-fold business form, as set forth in claim 1, wherein said form includes a fourth line of weakness formed in said second and third panels in parallel spaced apart relationship with said third line of weakness and defining a tab portion of said return envelope therebetween, said selectively activated adhesive being disposed on said tab portion.

3. The Z-fold business form, as set forth in claim 2, wherein said first line of weakness is formed by a plurality of perforations extending between the two side edges of the first panel, said second line of weakness is formed by a plurality of perforations extending between a side edge of said second panel adjacent said data portion and said fourth line of weakness, said third and fourth lines of weakness are respectively formed by a plurality of perforations extending between said first line of weakness and said bottom edge of the form.

4. The Z-fold business form, as set forth in claim 1, wherein said coactive adhesive areas have a coating of a pressure-activated adhesive deposited thereon.

5. The Z-fold business form, as set forth in claim 1, wherein said coactive adhesive areas have a coating of a heat activated adhesive deposited thereon.

6. The Z-fold business form, as set forth in claim 1, wherein said coactive adhesive areas disposed on the front faces of said first and second panels collectively have a smaller surface area than the collective surface area of the coactive adhesive areas disposed on the rear faces of said second and third panels.

7. The Z-fold business form, as set forth in claim 1, wherein the predefined pattern of said coactive adhesive areas disposed on the front face of said second panel is nonaligned with respect to the predefined pattern of coactive adhesive areas disposed on the rear face of said second panel whereby said forms can be stacked with the respective front faces all facing in the same direction without said coactive adhesive areas of adjacently stacked forms being in mutual contact.

8. The Z-fold business form, as set forth in claim 1, wherein said selectively activated adhesive is a moisture activated adhesive.

9. The Z-fold business form, as set forth in claim 1, wherein said selectively activated adhesive is a pressure-sensitive adhesive that is exposed by removal of a release liner.

10. The Z-fold business form, as set forth in claim 1, wherein the front face of said first panel is adapted to be selectively printed with account information for a specific recipient, and the rear face of said first panel is adapted to be preprinted initial opening instructions for all recipients of said form.

11. The Z-fold business form, as set forth in claim 1, wherein the front face of the envelope portion of one of said second and third panels is adapted to be selectively printed with a return address for said envelope.

12. The Z-fold business form, as set forth in claim 1, wherein the front face of the data portion of one of said second and third panels is adapted to be selectively printed with return receipt information whereby, after separation of the data and envelope portions of the second and third panels, said return receipt can be inserted into said preconstructed return envelope prior to sealing said return envelope in response to sealing said fourth side of the return envelope.

13. The Z-fold business form, as set forth in claim 1, wherein the front face of the data portion of one of said third panel is adapted to be selectively printed with the mailing address of a specific initial recipient.

14. The Z-fold business form, as set forth in claim 1, wherein said selectively activated adhesive is disposed on the rear face of a preselected one of said second and third panels at a position adjacent said fourth line of weakness.

15. The Z-fold business form, as set forth in claim 1, wherein said selectively activated adhesive is disposed on the rear face of said third panel at a position adjacent the bottom edge of said form.

16. The Z-fold business form, as set forth in claim 1, wherein the rear face of at least the envelope portion of said second and third panels is preprinted with privacy markings to render the contents of said preprinted return envelope generally unreadable.

17. The Z-fold business form, as set forth in claim 1, wherein said first, second and third panels each have generally equal height and width.

18. The Z-fold business form, as set forth in claim 1, wherein said first and second panels each have generally equal height and width, and said third panel has a width generally equal to said first and second panels and a height less than said first and second panels.

19. The Z-fold business form, as set forth in claim 1, wherein said front face of the form is adapted to be selectively printed with address and account information specific to a predesignated recipient and use application, and said rear face of the form is adapted to be preprinted with nonspecific markings and instructions applicable to all use applications.

* * * * *